US009289895B1

(12) United States Patent
Bauer

(10) Patent No.: US 9,289,895 B1
(45) Date of Patent: Mar. 22, 2016

(54) ADAPTER FOR EXTENDING A TOOL HANDLE

(71) Applicant: Martin C. Bauer, Highmore, SD (US)

(72) Inventor: Martin C. Bauer, Highmore, SD (US)

( * ) Notice: Subject to any disclaimer, the term of this patent is extended or adjusted under 35 U.S.C. 154(b) by 0 days.

(21) Appl. No.: 14/624,670

(22) Filed: Feb. 18, 2015

(51) Int. Cl.
*A46B 17/02* (2006.01)
*A46B 5/00* (2006.01)
*B25G 3/20* (2006.01)

(52) U.S. Cl.
CPC ... *B25G 3/20* (2013.01); *A46B 5/00* (2013.01); *A46B 5/0095* (2013.01); *A46B 17/02* (2013.01)

(58) Field of Classification Search
CPC ..... A46B 5/00; A46B 5/0095; A46B 17/02; B25G 3/20; B25G 3/24
See application file for complete search history.

(56) References Cited

U.S. PATENT DOCUMENTS

| | | | | | |
|---|---|---|---|---|---|
| 592,838 | A | * | 11/1897 | Solem | 15/146 |
| 936,150 | A | | 10/1909 | Nelson | |
| 1,599,273 | A | * | 9/1926 | Benkosky et al. | 15/146 |
| 2,057,225 | A | * | 10/1936 | Bernick | 15/146 |
| 2,346,570 | A | | 4/1944 | Francis | |
| 2,469,050 | A | | 5/1949 | Mygas | |
| 2,687,865 | A | | 8/1954 | Young | |
| 2,868,051 | A | | 1/1959 | Dupre | |
| 3,319,280 | A | * | 5/1967 | Trachsler | 15/146 |
| 3,357,035 | A | * | 12/1967 | Ficke | 15/144.1 |
| 3,413,043 | A | * | 11/1968 | Bertolina | 403/393 |
| 3,994,037 | A | * | 11/1976 | Sims | 15/146 |
| D263,677 | S | * | 4/1982 | Clark | D8/396 |
| 4,325,157 | A | | 4/1982 | Balint | |
| 4,525,889 | A | * | 7/1985 | Dunau | 15/146 |
| 4,729,587 | A | * | 3/1988 | Ward | 248/113 |
| D299,693 | S | | 2/1989 | Wick | |
| 4,926,522 | A | | 5/1990 | Wang | |
| 5,056,952 | A | | 10/1991 | Gringer | |
| 5,094,564 | A | * | 3/1992 | Tedrick | 403/373 |
| 5,123,768 | A | | 6/1992 | Franklin | |
| 5,752,287 | A | | 5/1998 | Wheat | |
| D396,755 | S | | 8/1998 | Lennox | |
| 6,038,787 | A | | 3/2000 | Dean | |
| 6,119,311 | A | | 9/2000 | Lavallee | |
| D456,147 | S | | 4/2002 | Anderson | |
| 6,473,929 | B1 | * | 11/2002 | Learned, III | 15/146 |
| D495,145 | S | | 8/2004 | Gladden | |
| 6,779,235 | B2 | | 8/2004 | Newman | |
| 7,300,081 | B1 | * | 11/2007 | Murray et al. | 294/58 |
| D556,458 | S | * | 12/2007 | Lanz | D4/199 |
| 8,251,603 | B2 | | 8/2012 | Kott | |
| 8,453,296 | B2 | | 6/2013 | Swerdlick | |
| 8,566,999 | B1 | | 10/2013 | Casey | |
| 8,839,480 | B2 | | 9/2014 | Thomas | |
| 8,959,698 | B2 | * | 2/2015 | Prosser et al. | 15/172 |

* cited by examiner

*Primary Examiner* — Randall Chin
(74) *Attorney, Agent, or Firm* — Jeffrey A. Proehl; Woods, Fuller, Shultz & Smith, P.C

(57) ABSTRACT

An adapter for mounting a tool on an extension handle, and the adapter may be elongated with a proximal end and a distal end with a longitudinal axis extending between the distal and proximal ends. The adapter may comprise a socket portion located toward the proximal end and being configured to mount on the extension shaft, and a mounting portion located toward the distal end and being configured to removably receive a portion of the handle of the tool. The mounting portion may include a mounting assembly that comprises an elongated spine member extending substantially along the longitudinal axis of the adapter, and a pair of mounting structures positioned on the spine member at longitudinally spaced positions on the spine member. Each of the mounting structures may comprise a loop of adjustable size.

19 Claims, 3 Drawing Sheets

ADAPTER FOR EXTENDING A TOOL HANDLE

BACKGROUND

Field

The present disclosure relates to tool holding adapters and more particularly pertains to a new adapter for extending a tool handle which facilitates the attachment of a common extension handle to a wide variety of tools.

SUMMARY

In one aspect, the present disclosure relates to an adapter for mounting a tool on an extension handle, and the adapter may be elongated with a proximal end and a distal end with a longitudinal axis extending between the distal and proximal ends. The adapter may comprise a socket portion located toward the proximal end and being configured to mount on the extension handle and a mounting portion located toward the distal end and being configured to removably receive a portion of the handle of the tool. The mounting portion may include a mounting assembly that may comprise an elongated spine member extending substantially along the longitudinal axis of the adapter and a pair of mounting structures positioned on the spine member at longitudinally spaced positions on the spine member. Each of the mounting structures may comprise a loop of adjustable size.

In another aspect, the present disclosure relates to a system comprising a tool having a handle and an operational element, with the handle having a tip at an end thereof. The system may also comprise an elongated extension handle with an exterior surface having external threads formed thereon, and an adapter being elongated with a proximal end and a distal end with a longitudinal axis extending between the distal and proximal ends. The adapter may comprise a socket portion located toward the proximal end and being removably threaded on the extension handle, and a mounting portion located toward the distal end. The mounting portion may include a mounting assembly comprising an elongated spine member extending substantially along the longitudinal axis of the adapter, and a pair of mounting structures positioned on the spine member at longitudinally spaced positions on the spine member. Each of the mounting structures may comprise a loop of adjustable size, with the handle of the tool being removably received in the loops of the mounting structures.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
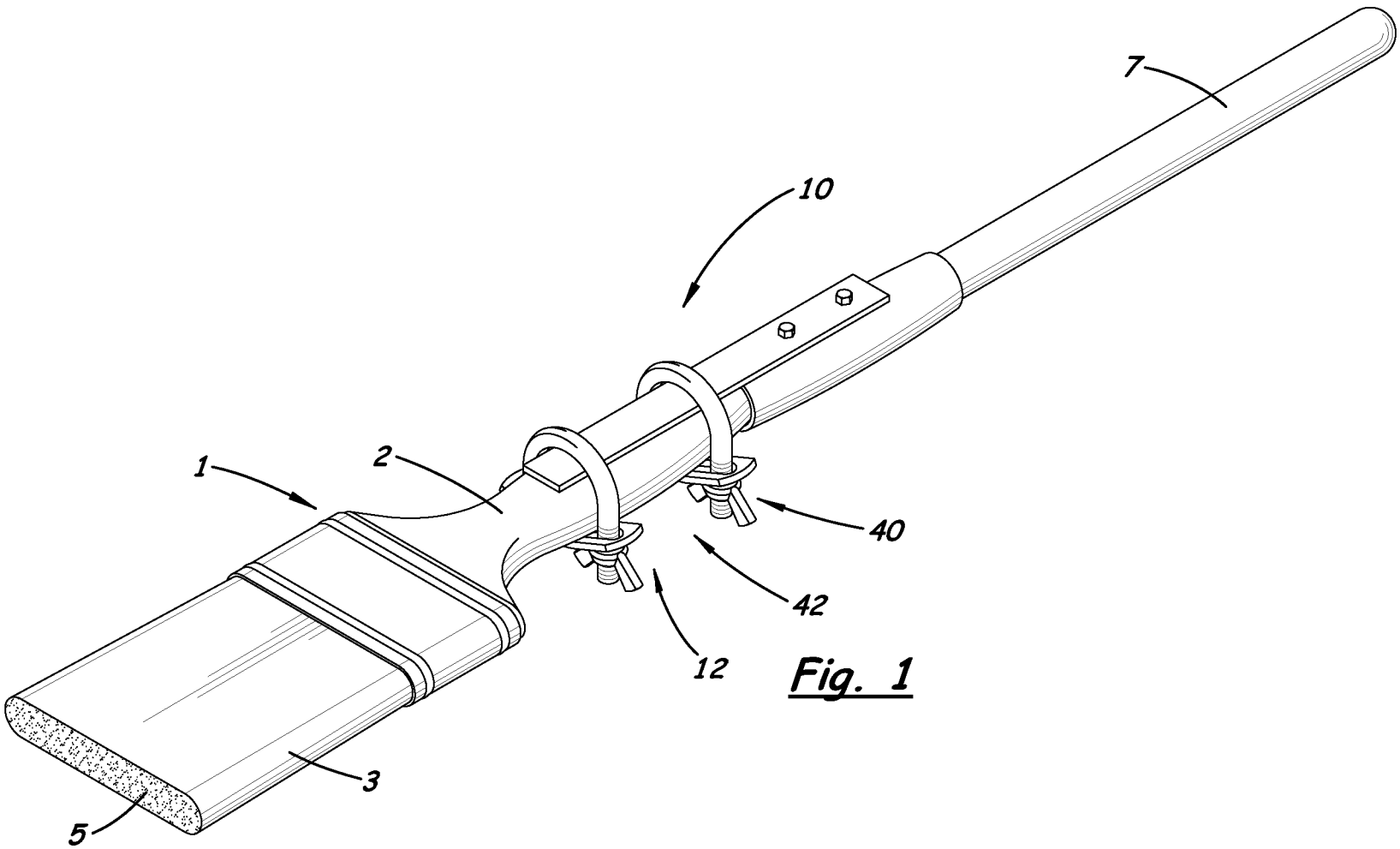
FIG. 1 is a schematic perspective view of a system including a new adapter for extending a tool handle according to the present disclosure.
Figure 2:
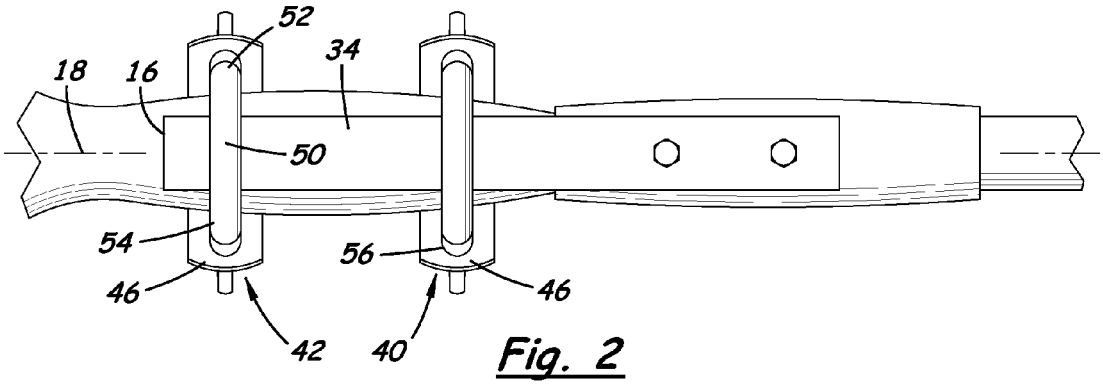
FIG. 2 is a schematic top view of the adapter and tool handle of the system, according to an illustrative embodiment.
Figure 3:
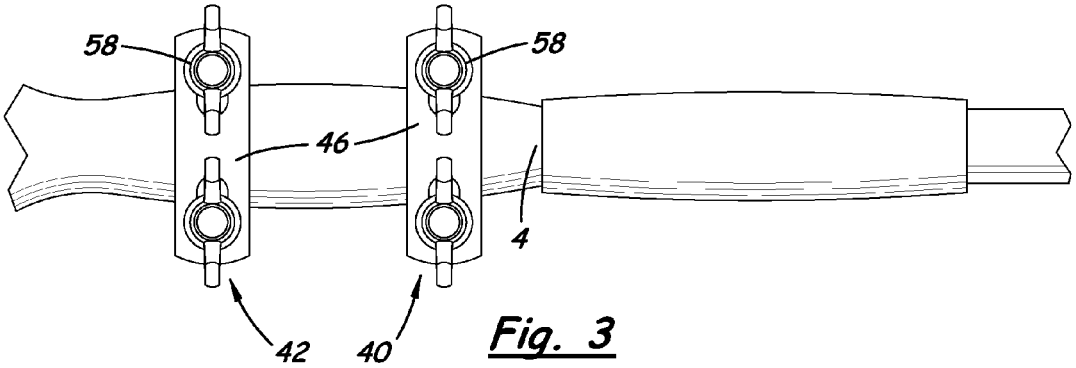
FIG. 3 is a schematic bottom view of the adapter and tool handle of the system, according to an illustrative embodiment.
Figure 4:
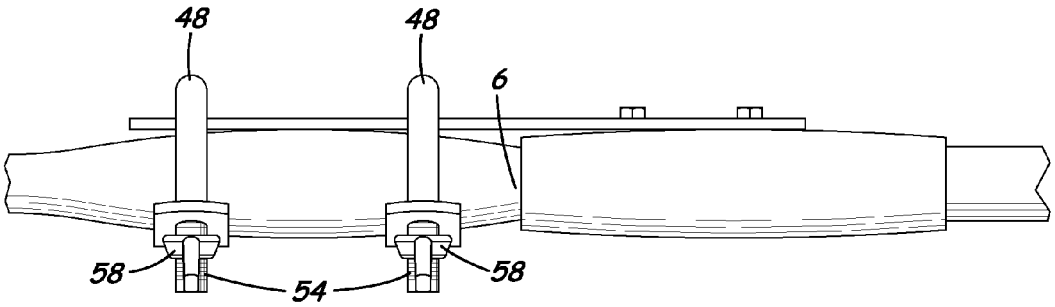
FIG. 4 is a schematic side view of the adapter and tool handle of the system, according to an illustrative embodiment.
Figure 5:
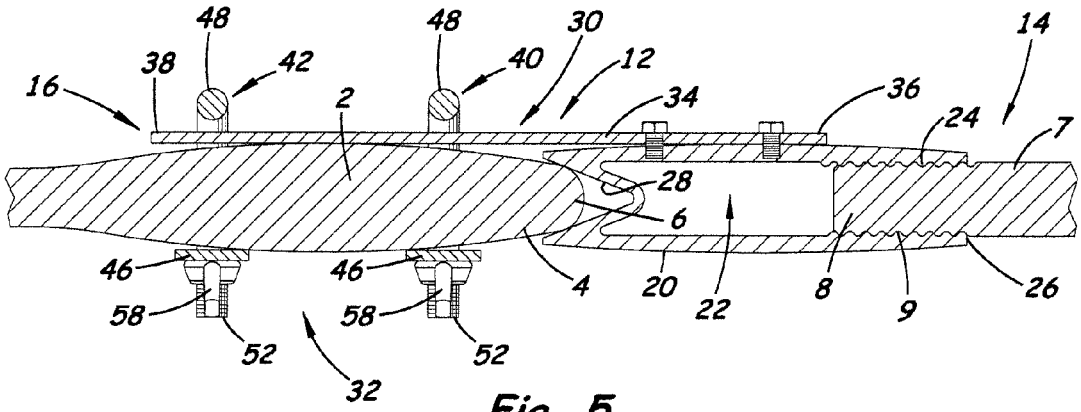
FIG. 5 is a schematic side sectional view of a portion of the system, according to an illustrative embodiment.
Figure 6:
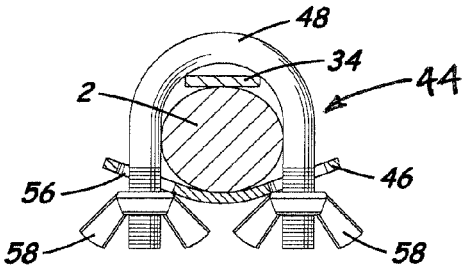
FIG. 6 is a schematic end sectional view of a portion of the system, according to an illustrative embodiment.

With reference now to the drawings, and in particular to FIGS. 1 through 6 thereof, a new adapter for extending a tool handle embodying the principles and concepts of the disclosed subject matter will be described.

Applicant has recognized that many tools would be more useful if to users of the tool was able to increase the reach of the tool without permanently increasing the length of the tool which would impair the ability to transport and store the tool. The applicant has devised an adapter that is able to removably attach a variety of tools to a common extension handle that typically comprise a pole which may have one of a variety of lengths, and thus may be selected for a suitable length for the task at hand.

One aspect of the disclosure relate to a system 10 that may include a tool 1, an extension handle 7 and an adapter 12 for mounting the tool on the extension handle. In greater detail, the tool may have a handle 2 and an operational element 3 for performing the work that the tool is intended to do. The tool 1 may generally have opposite ends 4, 5 with the handle being located at a first one 4 of the ends and the operational element 3 of the tool being located at a second one 5 of the ends. The handle 2 may have a tip 6 located at the first end 4 of the handle, and in some embodiments of the tool the tip may be tapered and may even be substantially pointed. More specifically, the handle 2 may have a lateral width which may taper smaller towards the first end 4 and the tip 6. Illustratively, and for the purposes of the description of this disclosure, the tool 1 may comprise a paint brush and the operational element 3 of the tool includes a plurality of bristles for holding and applying paint to a surface. However, it should be recognized that the tool may include virtually any tool, and is especially suitable for tools that include a handle designed or configured for being gripped or held by the hand of a human, typically with the an operational element located opposite of the handle and designed to engage something for the purpose for performing a task.

The extension handle 7 may be elongated with opposite ends and may have an exterior surface that extends between the ends. The exterior surface of the extension handle may be generally or substantially cylindrical in shape. The exterior surface of an outboard end portion of the handle 7 located towards a first one 8 of the ends may have external threads 9 formed thereon. The threads are typically of a standardized thread size and pitch known, for example, in the paint roller extension handle technology.

The adapter 12 may be elongated with a proximal end 14 and a distal end 16 with a longitudinal axis 18 that extends between the distal 16 and proximal 14 ends. The adapter 12 may generally comprise a socket portion 20 for engaging the extension handle and a mounting portion 30 for engaging the tool. In greater detail, the socket portion 20 may be configured to mount on the extension handle 7 and may be located toward the proximal end 14 of the adapter 12. The socket portion may be configured to receive the end portion of the extension handle, and may suitably engage the external threads 9 formed on the end portion of the handle 7. The socket portion 20 may define a cavity 22 for receiving the end portion of the handle 7, and the cavity may have internal threads 24 formed therein and configured to engage the external threads on the end portion. The cavity may have an opening 26 located at the proximal end 14 and that opens into the cavity 22 such that insertion of the end portion of the handle is initiated by insertion through the opening 26 and into the interior of the cavity 22.

The socket portion 20 may also include a recess 28 for receiving the tip 6 of the handle 2 of the tool when the tool is mounted on the adapter 12 for helping to keep the handle 2 centered one the adapter 12. The recess 28 may be oriented opposite of the opening 26 of the cavity, and the recess may be oriented generally toward the distal end 16 of the adapter. In some embodiments, the recess may have a width that tapers narrower toward the proximal end, such that the recess has a conical or substantially conical shape extending into the socket portion for the purpose of generally adapting to the shapes and sizes of the tips of different handles 2.

The mounting portion 30 may be located toward the distal end 16 of the adapter 12 and may be configured to mount to the tool 1 such as by removably receiving a portion of the handle when the tool is mounted on the mounting portion 30. Illustratively, the mounting portion 30 may be configured to grip the handle 2 of the tool. The mounting portion 30 may comprise a mounting assembly 32, which in turn may include a spine member 34 which may be elongated to extend substantially along the longitudinal axis 18 of the adapter. The spine member may have a base end 36 and a free end 38, with a base end being connected to the socket portion 20 and the free end being located toward the distal end 16 of the adapter. In some embodiments, at least one screw or other suitable fastener may mount the spine member 34 to the socket portion 20.

The mounting assembly 32 may also include at least one mounting structure 40 positioned on the spine member, and in many embodiments a pair of mounting structures 40, 42 may be employed at longitudinally spaced positions on the spine member 34 to engage spaced locations on the handle 2 of the tool to more securely grip the tool handle 2 while resisting any lateral pivoting of the tool with respect to the adapter that may be caused by the use of the tool to engage a workpiece.

In some embodiments, each of the mounting structures may comprise a loop 44 which has an adjustable size, such as an adjustable diameter. In some embodiments, the loop may comprise a strap 46 and a fastener 48, with the strap being attached to or mounted on the fastener. The fastener 48 may be mounted on the spine member 34, and the strap 46 may be removably mounted on the fastener. In some embodiments, the strap 46 may be flexible to at least partially conform to a portion of the exterior of the handle 2 of the tool, although in some embodiments the strap may be relatively rigid. The fastener 48 may be substantially U-shaped with a center extent 50 and spaced legs 52, 54 with the center extent being mounted on the spine member. The U-shaped configuration of the fastener may tend to center the handle within the loop 44. The strap 46 may engage and be attached to each of the legs 52, 54, and in some embodiments each of the legs may extend through a respective hole 56 formed in the strap. The legs of the fastener may be threaded and the threaded portions may extend through the holes in the strap. The fastener may further include a nut 58 removably mounted on each of the respective legs 52, 54, and the nuts may be positioned on the legs such that the nuts retain the strap on the fastener. The nuts may be tightened on the strap to cause the strap to effectively constrict the size of the loop 44 and clamp the handle against the center extent of the fastener in a relatively snug and tight relationship during use, and the nuts may be loosened to effectively enlarge the loop 44 and release the handle and allow the tool to be removed from the adapter 12. In some embodiments, the nuts 58 may comprise wing nuts to facilitate finger manipulation of the nuts to tighten and loosen the position of the nuts on the legs of the fastener.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. An adapter for mounting a tool on an extension handle, the adapter being elongated with a proximal end and a distal end with a longitudinal axis extending between the distal and proximal ends, the adapter comprising:

a socket portion located toward the proximal end and being configured to mount on the extension handle; and a mounting portion located toward the distal end and being configured to removably receive a portion of a handle of the tool, the mounting portion including a mounting assembly comprising:

an elongated spine member extending substantially along the longitudinal axis of the adapter;

a pair of mounting structures positioned on the spine member at longitudinally spaced positions on the spine member, each of the mounting structures comprising a loop of adjustable size, each of the loops being configured to contact a portion of the handle of the tool at the respective longitudinally-spaced position in a manner that is independent of another one of the loops;

wherein the loop includes a strap and a fastener, the strap being adjustably mounted on the fastener to adjust the size of the loop.

2. The adapter of claim 1 wherein the strap is configured to directly contact a surface of the handle of the tool when the handle is received by the mounting portion.

3. The adapter of claim 1 wherein the fastener is mounted on the spine member.

4. The adapter of claim 1 wherein the strap is flexible to at least partially conform to a portion of the exterior of the handle of the tool.

5. The adapter of claim 1 wherein the fastener is substantially U-shaped.

6. The adapter of claim 5 wherein the U-shaped fastener has a center extent and spaced legs, the center extent being mounted on the spine member.

7. The adapter of claim 6 wherein the strap engages the legs of the U-shaped fastener.

8. The adapter of claim 7 wherein the legs each extend through a hole in the strap.

9. The adapter of claim 8 wherein portions of the legs are threaded and a nut is threaded on each of the legs to releasably retain the strap on the fastener.

10. The adapter of claim 9 wherein the nuts comprise wing nuts.

11. The adapter of claim 1 wherein the socket portion defines a cavity at the proximal end of the socket portion for receiving the end portion of the extension handle.

12. The adapter of claim 1 wherein the strap is configured to directly contact a surface of the handle of the tool when the handle is received by the mounting portion;

wherein the fastener is mounted on the spine member;

wherein the strap is flexible to at least partially conform to a portion of the exterior of the handle of the tool;

wherein the fastener is substantially U-shaped;

wherein the U-shaped fastener has a center extent and spaced legs, the center extent being mounted on the spine member;

wherein the strap engages the legs of the U-shaped fastener;

wherein the legs each extend through a hole in the strap;

wherein portions of the legs are threaded and a nut is threaded on each of the legs to releasably retain the strap on the fastener;

wherein the nuts comprise wing nuts;

wherein the socket portion defines a cavity at the proximal end of the socket portion for receiving the end portion of the extension handle;

wherein the cavity has internal threads formed therein and configured to engage external threads on a portion of the extension handle; and wherein the socket portion has a recess for receiving the tip of the handle of the tool when the tool is mounted thereon, the recess being oriented opposite of an opening of the cavity, the socket portion being configured such that the socket portion extends around the tip of a handle positioned in the recess to resist lateral movement of the tip out of the recess.

13. An adapter for mounting a tool on an extension handle, the adapter being elongated with a proximal end and a distal end with a longitudinal axis extending between the distal and proximal ends, the adapter comprising:

a socket portion located toward the proximal end and being configured to mount on the extension handle; and a mounting portion located toward the distal end and being configured to removably receive a portion of a handle of the tool, the mounting portion including a mounting assembly comprising:

an elongated spine member extending substantially along the longitudinal axis of the adapter;

a pair of mounting structures positioned on the spine member at longitudinally spaced positions on the spine member, each of the mounting structures comprising a loop of adjustable size, each of the loops being configured to contact a portion of the handle of the tool at the respective longitudinally-spaced position in a manner that is independent of another one of the loops;

wherein the socket portion defines a cavity at the proximal end of the socket portion for receiving the end portion of the extension handle;

wherein the socket portion has a recess for receiving the tip of the handle of the tool when the tool is mounted thereon, the recess being oriented opposite of an opening of the cavity, the socket portion being configured such that the socket portion extends around the tip of the handle positioned in the recess to resist lateral movement of the tip out of the recess.

14. The adapter of claim 13 wherein the loop includes a strap and a fastener, the strap being adjustably mounted on the fastener to adjust the size of the loop.

15. A system comprising:

a tool having a handle and an operational element, the handle having a tip at an end thereof;

an elongated extension handle with an exterior surface having external threads formed thereon;

an adapter being elongated with a proximal end and a distal end with a longitudinal axis extending between the distal and proximal ends, the adapter comprising:

a socket portion located toward the proximal end and being removably threaded on the extension handle; and a mounting portion located toward the distal end, the mounting portion including a mounting assembly comprising:

an elongated spine member extending substantially along the longitudinal axis of the adapter;

a pair of mounting structures positioned on the spine member at longitudinally spaced positions on the spine member, each of the mounting structures comprising a loop of adjustable size, the handle of the tool being removably received in the loops of the mounting structures, each of the loops being configured to contact a portion of the handle of the tool at the respective longitudinally-spaced position in a manner such that adjustment of a size of one of the loops is independent of a size of another one of the loops;

wherein the loop includes a strap and a fastener, the strap being adjustably mounted on the fastener to adjust the size of the loop.

16. The system of claim 15 wherein the tool comprises a paint brush and the operational element of the tool includes a plurality of bristles.

17. The system of claim 15 wherein the socket portion defines a cavity at the proximal end of the socket portion for receiving the end portion of the extension handle.

18. The system of claim 15 wherein the strap is flexible to at least partially conform to a portion of the exterior of the handle of the tool.

19. The system of claim 15 wherein the socket portion has a recess for receiving the tip of the handle of the tool when the tool is mounted thereon, the socket portion being configured such that the socket portion extends around the tip of the handle positioned in the recess to resist lateral movement of the tip out of the recess.

* * * * *